US010977874B2

(12) United States Patent
Dorenkamp et al.

(10) Patent No.: US 10,977,874 B2
(45) Date of Patent: Apr. 13, 2021

(54) COGNITIVE LEARNING FOR VEHICLE SENSOR MONITORING AND PROBLEM DETECTION

(71) Applicant: INTERNATIONAL BUSINESS MACHINES CORPORATION, Armonk, NY (US)

(72) Inventors: Austin J. Dorenkamp, Rochester, MN (US); Jonathan C. F. Fouk, Rochester, MN (US); Paul F. Gerver, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 226 days.

(21) Appl. No.: 16/004,659

(22) Filed: Jun. 11, 2018

(65) Prior Publication Data

US 2019/0378351 A1 Dec. 12, 2019

(51) Int. Cl.
*G07C 5/08* (2006.01)
*G07C 5/00* (2006.01)

(52) U.S. Cl.
CPC ..... *G07C 5/006* (2013.01); *G07C 5/085* (2013.01); *G07C 5/0808* (2013.01)

(58) Field of Classification Search
CPC ..... G07C 5/08; G07C 5/0808; G07C 5/0816; G07C 5/0841; G06K 9/00805; G06K 9/629; H04L 67/10; H04L 67/12; H04L 67/125
USPC ..... 701/31.8, 29.1, 36, 31.4, 45, 29.7; 340/438, 10, 425.5
See application file for complete search history.

(56) References Cited

U.S. PATENT DOCUMENTS 4,497,057 A * 1/1985 Kato ..... G07C 5/0808 340/461
6,285,298 B1 * 9/2001 Gordon ..... G05B 9/03 340/945

(Continued)

FOREIGN PATENT DOCUMENTS

WO 2016065320 A1 4/2016

OTHER PUBLICATIONS

Anderton, ""Cognitive Vehicles" Will Have Big Implications for the Auto Supply Chain," engineering.com Manufacturing Article, Jan. 16, 2015, p. 1-4, engineering.com, Inc., https://www.engineering.com/AdvancedManufacturing/ArticleID/9388/, Accessed on Jun. 4, 2018.

(Continued)

*Primary Examiner* — Richard A Goldman
(74) *Attorney, Agent, or Firm* — Kristofer L. Haggerty

(57) ABSTRACT

A computer-implemented method for vehicle event management. The method receives one or more sets of vehicle sensor data from a first vehicle, wherein the one or more sets of vehicle sensor data correspond to one or more sensor systems of the first vehicle. The method further maps the received one or more sets of vehicle sensor data with one or more candidate vehicle events, based on one or more sets of archived vehicle sensor data. The method further identifies one or more relationships between the received one or more sets of vehicle sensor data and the one or more candidate vehicle events, and provides an alert, to the first vehicle, with the identified one or more relationships between the received one or more sets of vehicle sensor data and the one or more candidate vehicle events.

19 Claims, 5 Drawing Sheets

(56) References Cited

U.S. PATENT DOCUMENTS 6,363,632 B1 * 4/2002 Stentz ..... E02F 3/437 37/414
6,462,649 B1 * 10/2002 Kimura ..... B60R 21/0173 340/425.5
6,487,478 B1 * 11/2002 Azzaro ..... B60L 3/12 340/3.1
6,931,307 B2 * 8/2005 Everhart ..... H04L 29/06 701/1
6,933,842 B2 8/2005 Oesterling et al.
6,946,978 B2 * 9/2005 Schofield ..... G01C 21/00 340/988
6,988,026 B2 * 1/2006 Breed ..... G07C 5/008 701/31.4
6,999,896 B2 * 2/2006 Takahashi ..... G01S 7/4026 702/181
7,103,460 B1 * 9/2006 Breed ..... B60C 23/0408 701/29.1
7,158,015 B2 * 1/2007 Rao ..... B60Q 9/006 340/428
7,239,946 B2 7/2007 Sowa
7,515,066 B2 * 4/2009 Watanabe ..... B60Q 11/00 340/903
8,340,854 B2 * 12/2012 Doulatshahi ..... G06Q 10/06 701/29.1
8,467,932 B2 * 6/2013 Nielsen ..... G06Q 10/0631 701/31.4
8,660,734 B2 2/2014 Zhu et al.
9,342,933 B2 5/2016 Olsen, III et al.
9,988,080 B2 * 6/2018 Sasaki ..... B62D 5/049
10,023,201 B1 7/2018 Fiedler et al.
2001/0002451 A1 * 5/2001 Breed ..... B60N 2/0232 701/36
2002/0173897 A1 * 11/2002 Leamy ..... F02C 9/28 701/100
2003/0065432 A1 * 4/2003 Shuman ..... G08G 1/096844 701/48
2004/0167686 A1 * 8/2004 Baker ..... B61L 5/06 701/19
2005/0192727 A1 * 9/2005 Shostak ..... B60C 23/041 701/37
2005/0209756 A1 * 9/2005 Ueno ..... B60R 21/0133 701/45
2005/0283280 A1 * 12/2005 Evans, Jr. ..... B60J 10/00 701/1
2006/0025897 A1 * 2/2006 Shostak ..... G08G 1/017 701/1
2007/0073473 A1 * 3/2007 Altan ..... G01S 13/931 701/518
2009/0173829 A1 * 7/2009 Hakki ..... B64D 17/80 244/139
2010/0121525 A1 * 5/2010 Le ..... B60K 28/14 701/36
2010/0153168 A1 * 6/2010 York ..... G06Q 10/0637 705/7.36
2012/0116663 A1 * 5/2012 Tsunekawa ..... B60T 7/22 701/300
2012/0143430 A1 * 6/2012 Broggi ..... G01S 17/86 701/28
2012/0245791 A1 9/2012 Yun et al.
2012/0296567 A1 * 11/2012 Breed ..... G01C 21/26 701/468
2012/0330532 A1 * 12/2012 Matsuura ..... F02D 41/0025 701/103
2014/0257622 A1 * 9/2014 Shamlian ..... G05D 1/0227 701/26
2014/0292543 A1 * 10/2014 Lahyani ..... B63B 45/00 340/984
2014/0309805 A1 * 10/2014 Ricci ..... B60R 25/25 701/1
2014/0324257 A1 * 10/2014 Dawson ..... B60L 15/20 701/22
2014/0328570 A1 * 11/2014 Cheng ..... H04N 21/8549 386/241
2015/0110350 A1 * 4/2015 Mian ..... G06T 7/593 382/103
2015/0127189 A1 * 5/2015 Mehr ..... B60W 30/165 701/1
2015/0178998 A1 6/2015 Attard et al.
2015/0272105 A1 * 10/2015 Peterson ..... G01N 33/0031 701/50
2015/0369618 A1 * 12/2015 Barnard ..... H04W 4/40 701/491
2016/0035150 A1 2/2016 Barfield, Jr. et al.
2016/0046308 A1 * 2/2016 Chung ..... B61L 25/021 701/20
2016/0140842 A1 5/2016 Park et al.
2017/0004712 A1 * 1/2017 Yang ..... G06Q 50/30
2017/0287233 A1 10/2017 Nix
2017/0297489 A1 * 10/2017 Fendt ..... H04N 7/181
2018/0082134 A1 * 3/2018 Sivaraman ..... B60Q 1/503
2018/0297630 A1 * 10/2018 Kim ..... B62D 5/0481
2018/0322791 A1 * 11/2018 Brooks ..... B61C 17/12
2019/0197497 A1 * 6/2019 Abari ..... G05D 1/0027
2020/0008028 A1 * 1/2020 Yang ..... G08G 1/012
2020/0028736 A1 * 1/2020 Park ..... H04W 72/1289

OTHER PUBLICATIONS

Anonymous, "Method and System for Providing Communications between Anonymous Vehicle Drivers," An IP.com Prior Art Database Technical Disclosure, Feb. 22, 2017, p. 1-2, IP.com No. IPCOM000249376D.

DGSI, "Track Monitoring in Canada," DGSI Slope Indicator, p. 1, http://www.slopeindicator.com/stories/cnrailtrackmonitor.php, Accessed on Jun. 5, 2018.

Fehrenbacher, "How Tesla is Ushering in the Age of the Learning Car," Fortune, Oct. 16, 2015, p. 1-4, http://fortune.com/2015/10/16/how-tesla-autopilot-learns/, Accessed on Jun. 4, 2018.

Hanford, "Onboard Monitoring Technology Continues to Provide Railroads with Better Ways to Monitor and Track Cars and Locomotives," Progressive Railroading: Rail News, Oct. 2009, p. 1-10, https://www.progressiverailroading.com/c_s/article.aspx?id=21686, Accessed on Jun. 5, 2018.

Heide et al., "The "Cognitive Car": A Roadmap for Research Issues in the Automotive Sector," Annual Reviews in Control, 2006, vol. 30, p. 197-203, Elsevier Ltd.

Kite-Powell, "This Cognitive Autonomous Vehicle Is Powered by You and IBM Watson," Forbes Tech, Jun. 21, 2016, p. 1-2, https://www.forbes.com/sites/jenniferhicks/2016/06/21/this-cognitive-autonomous-vehicle-is-powered-by-you-and-ibm-watson/#3c6eeaa7ba18, Accessed on Jun. 4, 2018.

Kromer et al., "A Multi-Sensor Remote Sensing Approach for Railway Corridor Ground Hazard Management," Geophysical Research Abstracts, 2015, 1 Page, vol. 17, EGU General Assembly 2015.

Mell et al., "The NIST Definition of Cloud Computing," National Institute of Standards and Technology, Sep. 2011, p. 1-3, Special Publication 800-145.

Moynihan et al., "Railway Safety Technologies," Railway Safety Act, Jul. 2007, p. 1-25, Research and Traffic Group.

Union Pacific Railroad, "Rail Technology Development at Union Pacific," Progressive Railroading: Rail News, Jun. 2012, p. 1-5, https://www.progressiverailroading.com/class_is/article.aspx?id=31254, Accessed on Jun. 5, 2018.

Weart, "Rail Car and Locomotive Monitoring Technology Update (Part 1)," Progressive Railroading: Rail News, Jul. 2013, p. 1-8, https://www.progressiverailroading.com/c_s/article.aspx?id=36742, Accessed on Jun. 5, 2018.

* cited by examiner

COGNITIVE LEARNING FOR VEHICLE SENSOR MONITORING AND PROBLEM DETECTION

BACKGROUND

The present disclosure relates generally to the field of cognitive computing and more particularly to data processing and dynamic monitoring of vehicle sensor systems in order to detect problem events.

Nowadays, vehicles are equipped with sensors that monitor a variety of specific variables such as engine performance, fuel economy, tire pressure, outside air temperature, and even weather conditions (i.e., rain, snow, hail, etc.). However, many of these sensors function independently of each other to monitor specific, pre-defined conditions.

SUMMARY

Embodiments of the present invention disclose a method, a computer program product, and a system.

A method, according to an embodiment of the invention, in a data processing system including a processor and a memory, for managing vehicle events. The method includes detecting one or more internet of things (IoT) devices within the plurality of zones. The method further includes receiving one or more sets of vehicle sensor data from a first vehicle, wherein the one or more sets of vehicle sensor data correspond to one or more sensor systems of the first vehicle. The method further includes mapping the received one or more sets of vehicle sensor data with one or more candidate vehicle events, based on one or more sets of archived vehicle sensor data. The method further includes identifying one or more relationships between the received one or more sets of vehicle sensor data and the one or more candidate vehicle events, and providing an alert, to the first vehicle, with the identified one or more relationships between the received one or more sets of vehicle sensor data and the one or more candidate vehicle events.

A computer program product, according to an embodiment of the invention, includes a non-transitory tangible storage device having program code embodied therewith. The program code is executable by a processor of a computer to perform a method. The method includes detecting one or more internet of things (IoT) devices within the plurality of zones. The method further includes receiving one or more sets of vehicle sensor data from a first vehicle, wherein the one or more sets of vehicle sensor data correspond to one or more sensor systems of the first vehicle. The method further includes mapping the received one or more sets of vehicle sensor data with one or more candidate vehicle events, based on one or more sets of archived vehicle sensor data. The method further includes identifying one or more relationships between the received one or more sets of vehicle sensor data and the one or more candidate vehicle events, and providing an alert, to the first vehicle, with the identified one or more relationships between the received one or more sets of vehicle sensor data and the one or more candidate vehicle events.

A computer system, according to an embodiment of the invention, includes one or more computer devices each having one or more processors and one or more tangible storage devices; and a program embodied on at least one of the one or more storage devices, the program having a plurality of program instructions for execution by the one or more processors. The program instructions implement a method. The method includes detecting one or more internet of things (IoT) devices within the plurality of zones. The method further includes receiving one or more sets of vehicle sensor data from a first vehicle, wherein the one or more sets of vehicle sensor data correspond to one or more sensor systems of the first vehicle. The method further includes mapping the received one or more sets of vehicle sensor data with one or more candidate vehicle events, based on one or more sets of archived vehicle sensor data. The method further includes identifying one or more relationships between the received one or more sets of vehicle sensor data and the one or more candidate vehicle events, and providing an alert, to the first vehicle, with the identified one or more relationships between the received one or more sets of vehicle sensor data and the one or more candidate vehicle events.

DETAILED DESCRIPTION

As stated earlier, vehicles nowadays are equipped with sensors that monitor a variety of specific variables such as engine performance, fuel economy, tire pressure, outside air temperature, and even weather conditions (i.e., rain, snow, hail, etc.). However, many of these sensors function independently of each other to monitor specific, pre-defined conditions.

A problem in the art of sensor monitoring of the various systems of a vehicle is that there are still so many things that a vehicle is unable to detect, such as a broken taillight, a loose body panel, unsecured loads, to name a few.

The present invention discloses a method that dynamically receives vehicle sensor data from various sensor systems and identifies one or more candidate vehicle problems, or events, based on mapped archival vehicle sensor data and user feedback.

By obtaining a snapshot of all vehicle sensor systems in a vehicle at the time a vehicle problem is detected, the present invention is able to identify a possible vehicle problem with a certain degree of confidence, and further increase the confidence level based on user feedback.

Hereinafter, exemplary embodiments of the present invention will be described in detail with reference to the attached drawings.

The present invention is not limited to the exemplary embodiments below, but may be implemented with various modifications within the scope of the present invention. In addition, the drawings used herein are for purposes of illustration, and may not show actual dimensions.

Figure 1:
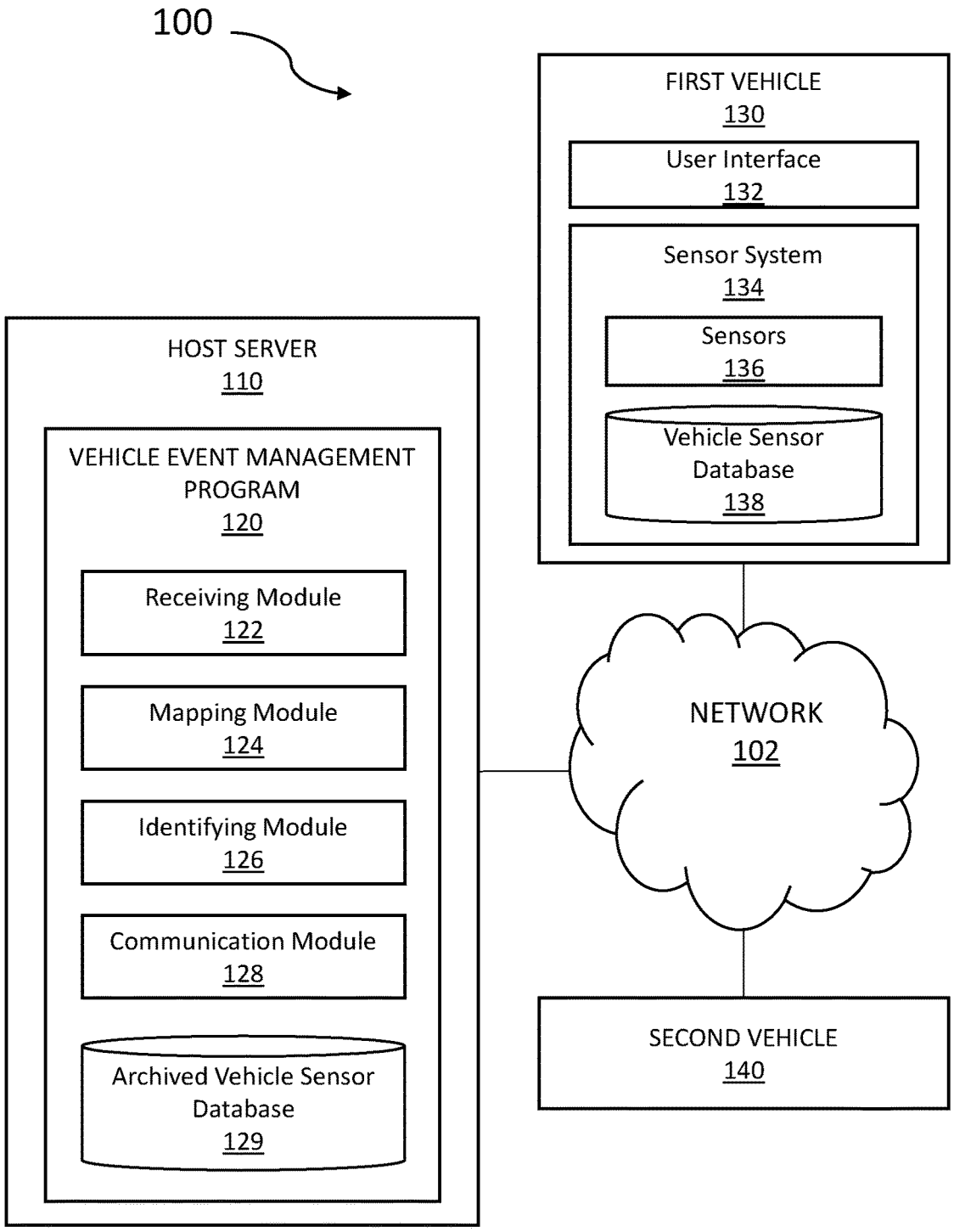
FIG. 1 illustrates a vehicle event management computing environment, in accordance with an embodiment of the present invention.

FIG. 1 illustrates vehicle event management computing environment 100, in accordance with an embodiment of the present invention. Vehicle event management computing environment 100 includes host server 110, first vehicle 130, and second vehicle 140 all connected via network 102. The setup in FIG. 1 represents an example embodiment configuration for the present invention, and is not limited to the depicted setup in order to derive benefit from the present invention.

In the example embodiment, host server 110 contains vehicle event management program 120. In various embodiments, host server 110 may be a laptop computer, tablet computer, netbook computer, personal computer (PC), a desktop computer, a personal digital assistant (PDA), a smart phone, a server, or any programmable electronic device capable of communicating with first vehicle 130 and second vehicle 140 via network 102. Host server 110 may include internal and external hardware components, as depicted and described in further detail below with reference to FIG. 3. In other embodiments, host server 110 may be implemented in a cloud computing environment, as described in relation to FIGS. 4 and 5, herein. Host server 110 may also have wireless connectivity capabilities allowing the host server 110 to communicate with first vehicle 130, second vehicle 140, and other computers or servers over network 102.

With continued reference to FIG. 1, first vehicle 130 contains user interface 132, sensor system 134, and vehicle sensor database 138. In exemplary embodiments, first vehicle 130 may be a car, a minivan, a truck, a tractor-trailer, a train, or any road vehicle containing one or more sensor systems 134. In alternative embodiments, first vehicle 130 may be any vehicle containing one or more sensor systems, such as a vehicle that flies in the sky (e.g., airplane, rocket ship, hot-air balloon, hovercraft, etc.), a vehicle that floats on the water (e.g., motorboat, yacht, jet ski, pontoon, freight ship, etc.), and any other vehicle known to one of ordinary skill in the art.

While the present invention focuses primarily on problem detection for vehicle sensor monitoring, the present invention is not limited to the defined scope, or category, of vehicles. For example, the present invention may be used for any electronic device, gadget, or defined space containing one or more sensor systems, such as houses, greenhouses, schools, museums, warehouses, construction and agricultural machinery, hydraulics, and so forth.

In an exemplary embodiment, first vehicle 130 includes user interface 132, which may be a computer program that allows a user to interact with first vehicle 130 and other connected devices via network 102. For example, user interface 132 may be a graphical user interface (GUI). In addition to comprising a computer program, user interface 132 may be connectively coupled to hardware components, such as those depicted in FIG. 3, for sending and receiving data. In an exemplary embodiment, user interface 132 may be a web browser, however in other embodiments user interface 132 may be a different program capable of receiving user interaction and communicating with other devices, such as host server 110.

In exemplary embodiments, user interface 132 may be a touch screen display, a remote operated display, or a display that receives input form a physical keyboard or touchpad located within first vehicle 130, such as on the dashboard, console, etc. In alternative embodiments, user interface 132 may be operated via voice commands, Bluetooth® (Bluetooth and all Bluetooth—based trademarks and logos are trademarks or registered trademarks of Bluetooth SIG, Inc. and/or its affiliates), a mobile device that connects to first vehicle 130, or by any other means known to one of ordinary skill in the art. In exemplary embodiments, a user may interact with user interface 132 to report a problem with first vehicle 130 and second vehicle 140. In various embodiments, a user may interact with user interface 132 to provide feedback to vehicle event management program 120, via network 102.

In an exemplary embodiment, first vehicle 130 includes a sensor system 134, which comprises one or more sensors 136. A sensor 136 is a device, module, or subsystem whose purpose is to detect events or changes in its environment and send the information to other electronics, such as host server 110. For example, one or more sensors 136 within first vehicle 130, when taken together, may comprise a sensor system 134 such as an engine sensor system, an electrical sensor system, a fuel sensor system, an emissions sensor system, a camera sensor system, a temperature sensor system, or any other compilation of sensors 136 within first vehicle 130 that, when taken together, comprise a sensor system 134. Typically, a sensor system 134 monitors specific, pre-defined conditions and works independently of other sensor systems 134 within an environment.

In exemplary embodiments, a sensor system 134, via the one or more sensors 136 that make up the sensor system 134, may be capable of providing a snapshot, or an overall status of the functioning of the sensor system 134 at a given moment in time. For example, sensor system 134 may be capable of reporting any malfunctioning sensors 136 or an increase/decrease in the sensor system 134 functionality, taken as a whole, at a given moment in time, over a pre-defined timeframe, or when a problem or malfunction is detected with first vehicle 130. For example, a broken taillight may affect existing sensors 136 that monitor first vehicle's 130 electrical system. In other embodiments, a loose body panel on first vehicle 130 may be detected via vehicle event management program 120 based on a decrease in overall fuel efficiency of first vehicle 130. Snapshots of multiple sensor systems 134, at a given moment in time, may provide an overall picture of the interaction of multiple sensor systems 134 in first vehicle 130.

In various embodiments, sensors 136 are embedded within various sensor systems 134 in first vehicle 130 that contain a computer processing unit (CPU), memory, and power resource, and may be capable of communicating with first vehicle 130, second vehicle 140, and host server 110 over network 102.

In exemplary embodiments, sensors 136 are capable of continuously monitoring, collecting, and saving collected data from a sensor system 134 on a local storage, such as vehicle sensor database 138, or sending the collected data to vehicle event management program 120 for analysis. In alternative embodiments, sensors 136 may be capable of detecting, communicating, pairing, or syncing with Internet of things (IoT) devices, thus creating opportunities for more direct integration of the physical world into computer-based systems, and resulting in improved efficiency, accuracy, and economic benefit in addition to reduced human intervention.

In addition to correlating one or more sensors 136 with a problem event, the present invention also correlates data received from one or more sensors 136 of first vehicle 130 with other sensors 136 of vehicle 130. For example, a collection of sensors 136, across various sensor systems 134, may be capable of simulating a failed, or non-functioning, sensor 136.

In exemplary embodiments, vehicle sensor database 138 may be local data storage on sensor system 134 that contains one or more sets of vehicle sensor data that correspond to one or more sensor systems 134 of first vehicle 130. For example, one or more sets of vehicle sensor data may include collected data, via sensors 136 for a particular sensor system 134, on a particular day, time, location, and so forth. In alternative embodiments, vehicle sensor database 138 may store the collected data according to snapshots of a particular sensor system 134 (e.g., electrical system, fuel efficiency system, etc.), or all sensor systems 134, based on a detected problem associated with a sensor system 134 at a given moment in time, or over a pre-configured time period.

While vehicle sensor database 138 is depicted as being stored on sensor system 134, in other embodiments, vehicle sensor database 138 may be stored on host server 110, vehicle event management program 120, or any other device or database connected via network 102, as a separate database. In alternative embodiments, vehicle sensor database 138 may be comprised of a cluster or plurality of computing devices, working together or working separately.

In exemplary embodiments, second vehicle 140 may include the same, or similar components as first vehicle 130, such as a user interface 132, and sensor system 134. In exemplary embodiments second vehicle 140 may be the same make or model as first vehicle 130 and as such, may be capable of communicating with first vehicle 130 via sensors 136 or by any other means known to one of ordinary skill in the art. Additionally, sensors 136 from second vehicle 140 may be capable of transmitting detected information from a first vehicle 130 directly to vehicle event management program 120, via network 102.

In alternative embodiments, a driver or passenger in second vehicle 140 may manually report (e.g., via user interface 132, mobile device, or by any other means known to one of ordinary skill in the art) an observed, or detected, problem with first vehicle 130, via network 102, to vehicle event management program 120. In various alternative embodiments, multiple vehicles may be used to detect, observe, and report problems associated with first vehicle 130, and transmit the detected, or observed, problems associated with first vehicle 130 to vehicle event management program 120, via network 102.

With continued reference to FIG. 1, vehicle event management program 120, in the example embodiment, may be a computer application on host server 110 that contains instruction sets, executable by a processor. The instruction sets may be described using a set of functional modules. In exemplary embodiments, vehicle event management program 120 may receive input from first vehicle 130 and second vehicle 140 over network 102. In alternative embodiments, vehicle event management program 120 may be a computer application contained within first vehicle 130, or a standalone program on a separate electronic device.

With continued reference to FIG. 1, the functional modules of vehicle event management program 120 include receiving module 122, mapping module 124, identifying module 126, communication module 128, and archived vehicle sensor database 129.

Figure 2:
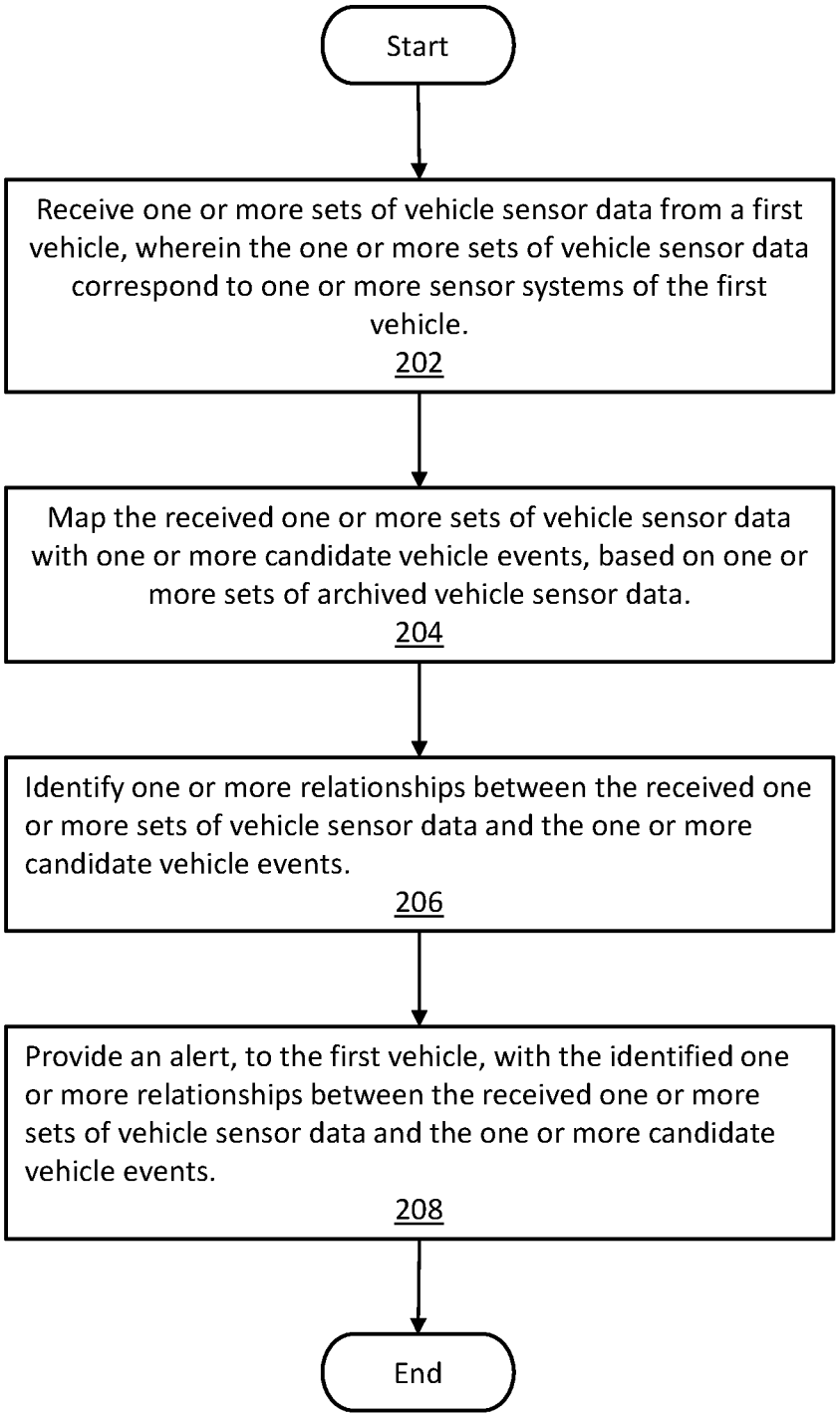
FIG. 2 is a flowchart illustrating the operation of vehicle event management program 120 of FIG. 1, in accordance with an embodiment of the present invention.

FIG. 2 is a flowchart illustrating the operation of vehicle event management program 120 of FIG. 1, in accordance with embodiments of the present invention.

With reference to FIGS. 1 and 2, receiving module 122 includes a set of programming instructions in vehicle event management program 120, to receive one or more sets of vehicular sensor data from first vehicle 130, wherein the one or more sets of vehicle sensor data correspond to one or more sensor systems 134 of first vehicle 130 (step 202). For example, a set of vehicle sensor data may relate solely to engine performance, while another set of vehicle sensor data may relate solely to electrical system performance.

With reference to an illustrative example, vehicle 130 got rear-ended by another vehicle in a parking lot, while it was parked. The driver of vehicle 130 is unaware of the accident and may not notice the broken rear-right taillight and loose rear-right body panels caused by the collision, upon her return to vehicle 130. The driver of vehicle 130 may thus drive on the highway, totally unaware of the hazard that vehicle 130 may be causing for other motorists, such as the inability of other motorists to see the brake lights of vehicle 130 or the possibility of a loose body panel breaking off while vehicle 130 is in motion. Since it is not feasible to fit vehicle 130 with sensors to specifically monitor the rear-right taillight or the rear-right body panel, or any one of infinitely additional problems that may go wrong with vehicle 130, receiving module 122 may receive a snapshot of all sensor systems of vehicle 130 while on the road. The data received from all sensor systems of vehicle 130 may provide a picture of the performance of individual sensor systems 134 and whether they are underperforming, overcompensating, and so forth. This information may be used to train vehicle event management program 120 in providing a narrowed set of problems that may be occurring, or need attention by a driver, as will be further explained below.

In exemplary embodiments, the more snapshots of sensor data received by receiving module 122 over time, together with user feedback identifying specific problems, or events, with associated sensor systems 134, may increase the accuracy of suggested candidate problems, or events, associated with first vehicle 130.

In alternative embodiments, a second vehicle 140 may detect one or more candidate vehicle events of the first vehicle 130, wherein the second vehicle 140 is within a pre-defined proximity of the first vehicle 130.

With continued reference to the illustrative example above, second vehicle 140 may be driving alongside first vehicle 130 on the highway. Second vehicle 140 may be the same make and model vehicle as first vehicle 130, and therefore outfitted with recognized sensors 136 and the ability to communicate with first vehicle 130, via network 102. Second vehicle 140 may be capable of receiving status reports, or snapshots, of the sensor systems 134 of first vehicle 130 and transmitting the same to vehicle event management program 120, via network 102. In various instances, the user of second vehicle 140 may or may not be capable of receiving the status reports of the sensor systems 134 of first vehicle 130. In this example, second vehicle 140 may be capable of detecting a non-functioning, or broken, rear-right taillight of first vehicle 130 and transmitting this information, either automatically or manually, to vehicle event management program 120 via network 102. The first vehicle 130 may then be notified via vehicle event management program 120 of a broken rear-right taillight.

In exemplary embodiments, receiving module 122 may archive the received sets of sensor data, of vehicle 130, in archived vehicle sensor database 129.

In exemplary embodiments, archived vehicle sensor database 129 is local data storage on vehicle event management program 120 that may contain a list of one or more problems, or events, associated with corresponding sensor systems 134 of vehicle 130. In exemplary embodiments, the sets of archived data in archived vehicle sensor database 129 may be organized into datasets according to sensor system, problem, and user feedback confirming the problem. For example, a data set may be stored as <electrical, broken_taillight, yes> or <fuel, leak, no>.

In alternative embodiments, archived vehicle sensor database 129 may be organized according to a snapshot of all sensor systems 134 for vehicle 130 at a given moment in time, together with a confidence level associated with the received snapshot of vehicle sensor data for all sensor systems 134, which may include user feedback confirming a detected problem, or variation of performance of one or more sensor systems 134. Over time, various vehicle problems, or events, may become more closely associated with the discovered variation of performance of one or more sensor systems 134, thus increasing the confidence levels of vehicle event management program's 120 assessment of received snapshots of vehicle sensor data.

While archived vehicle sensor database 129 is depicted as being stored on vehicle event management program 120, in other embodiments, archived vehicle sensor database 129 may be stored on host server 110, first vehicle 130, or any other device or database connected via network 102, as a separate database. In alternative embodiments, archived vehicle sensor database 129 may be comprised of a cluster or plurality of computing devices, working together or working separately.

With continued reference to FIGS. 1 and 2, mapping module 124 includes a set of programming instructions in vehicle event management program 120, to map the received one or more sets of vehicle sensor data with one or more candidate vehicle events, based on one or more sets of archived vehicle sensor data (step 204). The set of programming instructions is executable by a processor.

In exemplary embodiments, mapping module 124 is capable of connecting specific first vehicle 130 problems, or events, with detected vehicle sensor data. In various embodiments, one or more candidate vehicle events may include alternative possibilities for a detected malfunction, or problem, associated with a particular sensor system 134 of first vehicle 130. For example, a decrease in the fuel efficiency system of first vehicle 130 may be attributed, or mapped, to a loose body panel of first vehicle 130, low air pressure in one or more tires of first vehicle 130, unsecure gas tank cover of vehicle 130, and so forth. In various embodiments, each aforementioned possibility may include a confidence level based on archived vehicle sensor data of first vehicle 130 and second vehicle 140, as well as other vehicles that contribute vehicle sensor data to vehicle event management program 120, via network 102.

In various embodiments, the vehicle sensor data, together with mapped problem possibilities of vehicle 130, may be stored in archived vehicle sensor database 129 and used as comparative data for sensor data received in the future.

In exemplary embodiments, vehicle event management program 120 may receive a first set of vehicle sensor data corresponding to a first set of vehicle sensors, as well as a second set of vehicle sensor data corresponding to a second set of vehicle sensors. A set of vehicle sensors may include one or more sensors 136 that comprise a particular sensor system 134 associated with first vehicle 130 (e.g., electrical system, fuel system, etc.). In exemplary embodiments, mapping module 124 may be capable of determining a correlation between the first set of vehicle sensors and the second set of vehicle sensors, and building a correlation model between the first set of vehicle sensors and the second set of vehicle sensors, based on the determined correlation.

With continued reference to the illustrative example above, mapping module 124 may be capable of mapping the detected electrical system problem with a broken taillight of vehicle 130, based on archived vehicle sensor data, together with driver feedback confirming the broken taillight. Additionally, mapping module 124 may be capable of mapping a loose body panel of vehicle 130 with a decrease in fuel efficiency of vehicle 130, based on archived vehicle sensor data, together with driver feedback confirming the loose body panel. Over time, vehicle event management program 120 may provide candidate vehicle problems to a user, based on the received snapshot of all sensor systems 134 performance of vehicle 130, with a higher degree of confidence.

In alternative embodiments, mapping module 124 may determine a correlation between received vehicle sensor data indicating a decrease in air pressure in one or more tires of vehicle 130 with a decrease in fuel efficiency, compared to normal fuel efficiency data when the air pressure in all tires of vehicle 130 are at optimal levels. The two sets of vehicle sensor data (e.g., lower air pressure in one or more tires, and a decrease in fuel efficiency; as well as optimal air pressure in all tires, and normal fuel efficiency) may be mapped by mapping module 124 and stored in archived vehicle sensor database 129 as a candidate vehicle event that caused the decrease in fuel efficiency.

In further embodiments, vehicle event management program 120 may detect that the first set of vehicle sensors has encountered a failure event, and associate the failure event of the first set of vehicle sensors with the one or more candidate vehicle events, based on the correlation model. In exemplary embodiments, a failure event may mean a problem that occurs with the first vehicle 130 such as an unsecured load, a broken headlight or taillight, or any other myriad of problems that may occur, and go undetected, with first vehicle 130.

In various exemplary embodiments, vehicle event management program 120 may receive a snapshot of the one or more sensor systems 134 of the first vehicle 130, in response to detecting that the first set of vehicle sensors has encountered a failure event, and aggregate the snapshot of the one or more sensor systems 134 of the first vehicle 130. Mapping module 124 may then determine one or more associations between the failure event and the received snapshot of the one or more sensor systems 134 of the first vehicle 130 and update the correlation model to include the one or more associations between the failure event and the received snapshot of the one or more sensor systems 134 of the first vehicle 130. In this way, vehicle event management program 120 is continuously mapping failure events with possible causes based on an overall picture of first vehicle's 130 sensor systems 134 at the moment in time that a failure event is detected.

In further embodiments, mapping module 124 may be capable of correlating the one or more sets of received vehicle sensor data from first vehicle 130 with the one or more sensor systems 134 of first vehicle 130, and detecting a failed sensor 136 associated with the one or more sensor systems 134 of first vehicle 130. In the event mapping module 124 detects a failed sensor 136, vehicle event management program 120 may be capable of simulating the failed sensor 136 using the correlated one or more sets of received vehicle sensor data associated with the one or more sensor systems 134 of first vehicle 130.

With reference to an illustrative example, if the wheel-speed sensor fails on first vehicle 130, the wheel-speed sensor may be able to be simulated using a collection of data from other sensors 136 such as rpm sensor, fuel-flow sensor, engine load sensor, GPS sensor, and so forth. This way, if the wheel-speed sensor is correlated with a problem event, and the wheel-speed sensor fails, vehicle event management program 120 may be capable of identifying other sensors 136 to simulate the wheel-speed sensor in order to still detect any problem events which depend on the wheel-speed sensor. In this fashion, various sensors 136 from one or more sensor systems 134 of vehicle 130 are analyzed collectively, rather than independently, in order to identify candidate vehicle problem events.

With continued reference to FIGS. 1 and 2, identifying module 126 includes a set of programming instructions in vehicle event management program 120, to identify one or more relationships between the received one or more sets of vehicle sensor data and the one or more candidate vehicle events (step 206). The set of programming instructions is executable by a processor.

In exemplary embodiments, vehicle event management program 120 may be capable of determining that the identified one or more relationships between the received one or more sets of vehicle sensor data and the one or more candidate vehicle events achieve an authenticity threshold. If an authenticity threshold is achieved, then identifying module 126 may add the identified one or more relationships between the received one or more sets of vehicle sensor data and the one or more candidate vehicle events to the one or more sets of archived vehicle sensor data.

In various exemplary embodiments, identifying module 126 may monitor, continuously, the one or more sets of vehicle sensor data from the one or more sensor systems 134, of the first vehicle 130, to identify the one or more candidate vehicle events.

With continued reference to the illustrative example above, identifying module 126 compares the received sensor data from the snapshot of sensor systems 134 of first vehicle 130, at the time of the problem event, with one or more candidate vehicle events that are mapped and stored in archived vehicle sensor database 129. Based on a confidence level for possible candidate vehicle events associated with the sensor systems 134 experiencing a problem, identifying module 126 returns a candidate vehicle event that first vehicle 130 may be experiencing. In this case, identifying module 126 identifies a loose rear-right body panel with a decrease in fuel efficiency of vehicle 130.

With continued reference to FIGS. 1 and 2, communication module 128 includes a set of programming instructions in vehicle event management program 120, to provide an alert, to first vehicle 130, with the identified one or more relationships between the received one or more sets of vehicle sensor data and the one or more candidate vehicle events (step 208). The set of programming instructions is executable by a processor.

In exemplary embodiments, communication module 128 may be capable of receiving user feedback from first vehicle 130, in response to the provided alert, and incorporating the received user feedback into confidence level data for the one or more relationships between the received one or more sets of vehicle sensor data and the one or more candidate vehicle events.

With continued reference to the illustrative example above, communication module 128 may provide an alert to first vehicle 130, via user interface 132, that a possible reason for the decrease in fuel efficiency is a loose body panel on first vehicle 130. The driver of vehicle 130 may then check for loose body panel and either confirm or reject the possible reason for the decrease in fuel efficiency. Communication module 128 transmits the driver's response feedback to vehicle event management program 120 and uses this information to increase confidence level data for future vehicle events.

In the example embodiment, network 102 is a communication channel capable of transferring data between connected devices and may be a telecommunications network used to facilitate telephone calls between two or more parties comprising a landline network, a wireless network, a closed network, a satellite network, or any combination thereof. In another embodiment, network 102 may be the Internet, representing a worldwide collection of networks and gateways to support communications between devices connected to the Internet. In this other embodiment, network 102 may include, for example, wired, wireless, or fiber optic connections which may be implemented as an intranet network, a local area network (LAN), a wide area network (WAN), or any combination thereof. In further embodiments, network 102 may be a Bluetooth network, a WiFi network, or a combination thereof. In general, network 102 can be any combination of connections and protocols that will support communications between host server 110, first vehicle 130, and second vehicle 140.

Figure 3:
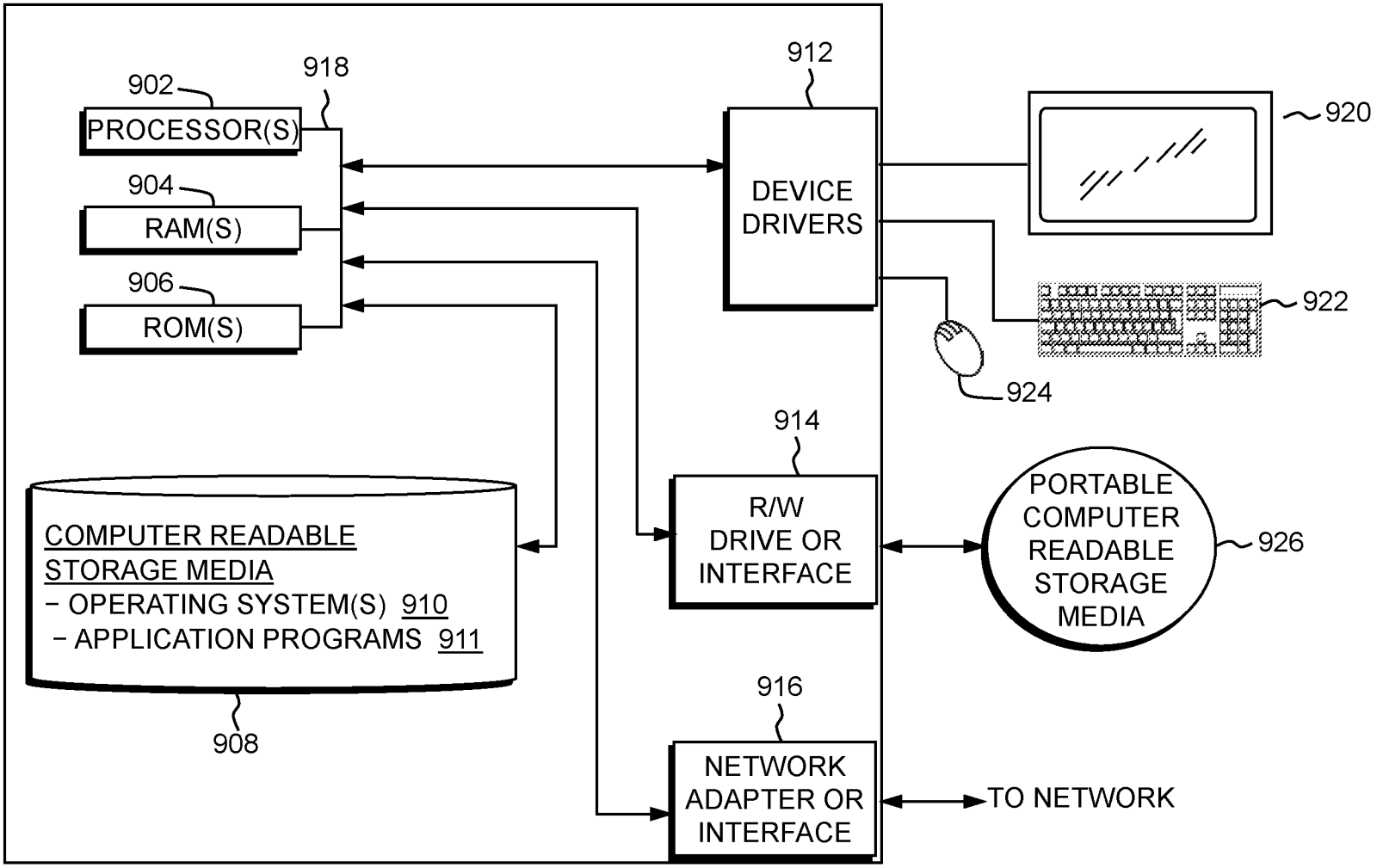
FIG. 3 is a diagram graphically illustrating the hardware components of vehicle event management computing environment of FIG. 1, in accordance with an embodiment of the present invention.

FIG. 3 is a block diagram depicting components of a computing device (such as host server 110, as shown in FIG. 1), in accordance with an embodiment of the present invention. It should be appreciated that FIG. 3 provides only an illustration of one implementation and does not imply any limitations with regard to the environments in which different embodiments may be implemented. Many modifications to the depicted environment may be made.

Host server 110 may include one or more processors 902, one or more computer-readable RAMs 904, one or more computer-readable ROMs 906, one or more computer readable storage media 908, device drivers 912, read/write drive or interface 914, network adapter or interface 916, all interconnected over a communications fabric 918. Communications fabric 918 may be implemented with any architecture designed for passing data and/or control information between processors (such as microprocessors, communications and network processors, etc.), system memory, peripheral devices, and any other hardware components within a system.

One or more operating systems 910, and one or more application programs 911, such as vehicle event management program 120, may be stored on one or more of the computer readable storage media 908 for execution by one or more of the processors 902 via one or more of the respective RAMs 904 (which typically include cache memory). In the illustrated embodiment, each of the computer readable storage media 908 may be a magnetic disk storage device of an internal hard drive, CD-ROM, DVD, memory stick, magnetic tape, magnetic disk, optical disk, a semiconductor storage device such as RAM, ROM, EPROM, flash memory or any other computer-readable tangible storage device that can store a computer program and digital information.

Host server 110 may also include a R/W drive or interface 914 to read from and write to one or more portable computer readable storage media 926. Application programs 911 on host server 110 may be stored on one or more of the portable computer readable storage media 926, read via the respective R/W drive or interface 914 and loaded into the respective computer readable storage media 908.

Host server 110 may also include a network adapter or interface 916, such as a TCP/IP adapter card or wireless communication adapter (such as a 4G wireless communication adapter using OFDMA technology). Application programs 911 on host server 110 may be downloaded to the computing device from an external computer or external storage device via a network (for example, the Internet, a local area network or other wide area network or wireless network) and network adapter or interface 916. From the network adapter or interface 916, the programs may be loaded onto computer readable storage media 908. The network may comprise copper wires, optical fibers, wireless transmission, routers, firewalls, switches, gateway computers and/or edge servers.

Host server 110 may also include a display screen 920, a keyboard or keypad 922, and a computer mouse or touchpad 924. Device drivers 912 interface to display screen 920 for imaging, to keyboard or keypad 922, to computer mouse or touchpad 924, and/or to display screen 920 for pressure sensing of alphanumeric character entry and user selections. The device drivers 912, R/W drive or interface 914 and network adapter or interface 916 may comprise hardware and software (stored on computer readable storage media 908 and/or ROM 906).

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Figure 4:
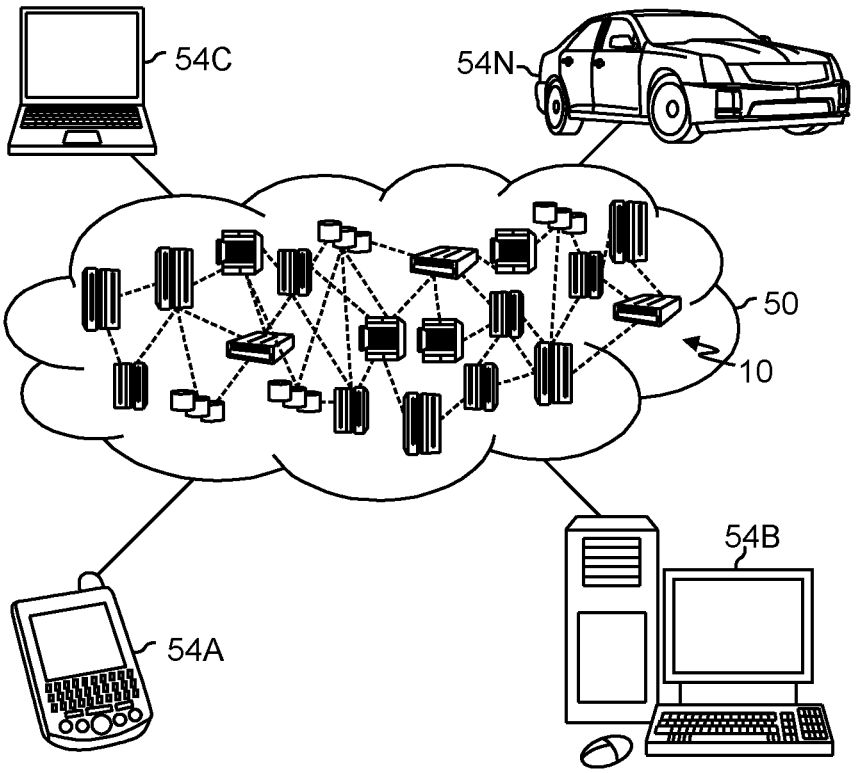
FIG. 4 depicts a cloud computing environment, in accordance with an embodiment of the present invention.

Referring now to FIG. 4, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 4 are intended to be illustrative only and that computing nodes 10 and cloud computing environment 50 can communicate with any type of computerized device over any type of network and/or network addressable connection (e.g., using a web browser).

Figure 5:
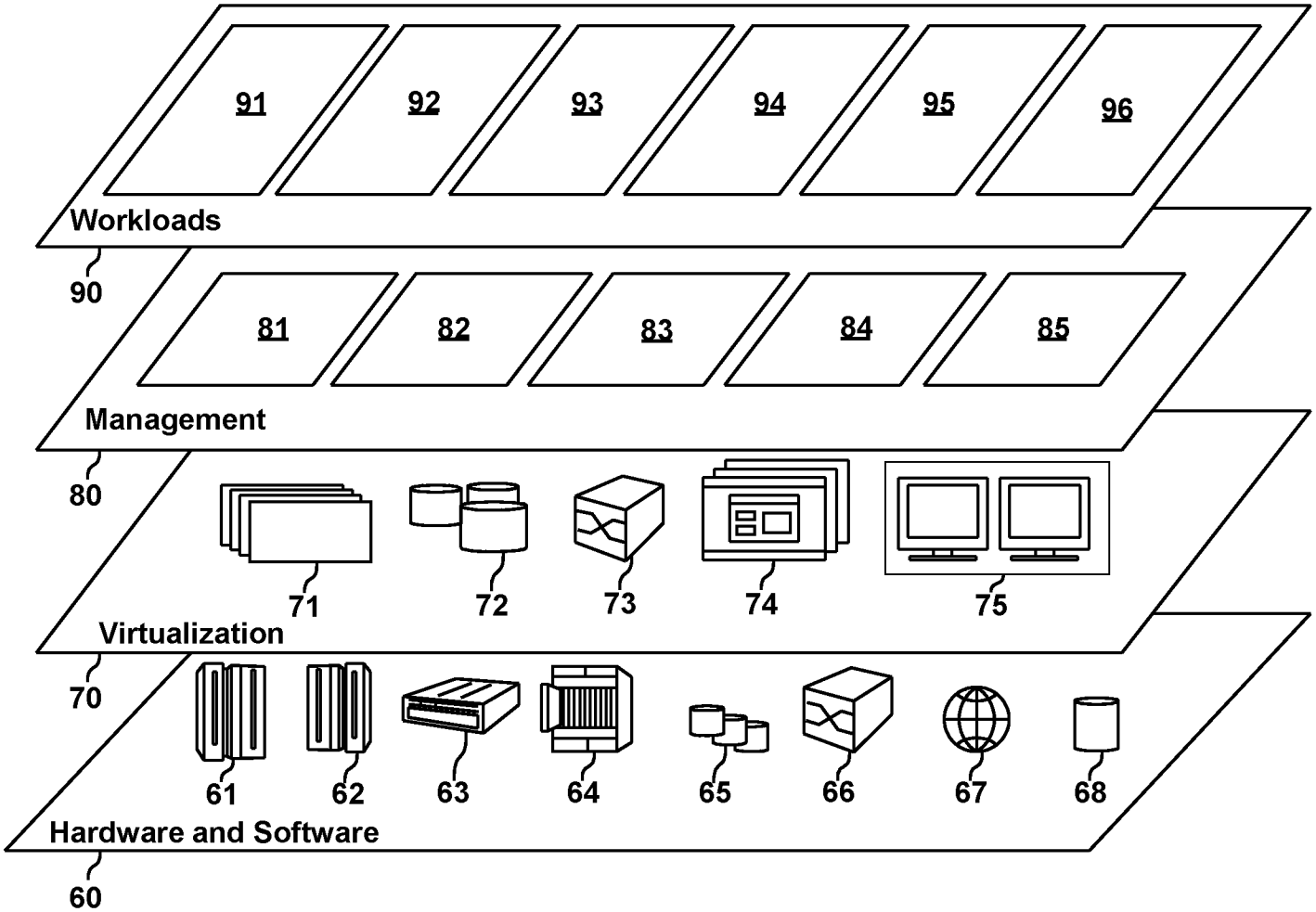
FIG. 5 depicts abstraction model layers of the illustrative cloud computing environment of FIG. 4, in accordance with an embodiment of the present invention.

Referring now to FIG. 5, a set of functional abstraction layers provided by cloud computing environment 50 (FIG. 4) is shown. It should be understood in advance that the components, layers, and functions shown in FIG. 5 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and controlling access to data objects 96.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Based on the foregoing, a computer system, method, and computer program product have been disclosed. However, numerous modifications and substitutions can be made without deviating from the scope of the present invention. Therefore, the present invention has been disclosed by way of example and not limitation.

The invention claimed is:

1. A computer-implemented method for vehicle event management, the method comprising:

receiving one or more sets of vehicle sensor data from a first vehicle, wherein the one or more sets of vehicle sensor data correspond to one or more sensor systems of the first vehicle;

mapping the received one or more sets of vehicle sensor data with one or more candidate vehicle events, based on one or more sets of archived vehicle sensor data;

identifying one or more relationships between the received one or more sets of vehicle sensor data and the one or more candidate vehicle events;

detecting, by a second vehicle, the one or more candidate vehicle events of the first vehicle, wherein the second vehicle is within a pre-defined proximity of the first vehicle; and providing an alert, to the first vehicle, that conveys the identified one or more relationships between the received one or more sets of vehicle sensor data and the one or more candidate vehicle events.

2. The computer-implemented method of claim 1, further comprising:

adding the identified one or more relationships between the received one or more sets of vehicle sensor data and the one or more candidate vehicle events to the one or more sets of archived vehicle sensor data.

3. The computer-implemented method of claim 1, further comprising:

receiving a first set of vehicle sensor data corresponding to a first set of vehicle sensors;

receiving a second set of vehicle sensor data corresponding to a second set of vehicle sensors;

determining a correlation between the first set of vehicle sensors and the second set of vehicle sensors; and building a correlation model between the first set of vehicle sensors and the second set of vehicle sensors, based on the determined correlation.

4. The computer-implemented method of claim 3, further comprising:

detecting that the first set of vehicle sensors has encountered a failure event; and associating the failure event of the first set of vehicle sensors with the one or more candidate vehicle events, based on the correlation model.

5. The computer-implemented method of claim 4, further comprising:

in response to detecting that the first set of vehicle sensors has encountered a failure event, receiving a snapshot of the one or more sensor systems of the first vehicle;

aggregating the snapshot of the one or more sensor systems of the first vehicle;

determining one or more associations between the failure event and the received snapshot of the one or more sensor systems of the first vehicle; and updating the correlation model to include the one or more associations between the failure event and the received snapshot of the one or more sensor systems of the first vehicle.

6. The computer-implemented method of claim 1, further comprising:

monitoring, continuously, the one or more sets of vehicle sensor data from the one or more sensor systems, of the first vehicle, to identify the one or more candidate vehicle events.

7. The computer-implemented method of claim 1, further comprising:

receiving user feedback from the first vehicle, in response to the provided alert; and incorporating the received user feedback into confidence level data, for the one or more relationships between the received one or more sets of vehicle sensor data and the one or more candidate vehicle events.

8. The computer-implemented method of claim 1, further comprising:

correlating the one or more sets of vehicle sensor data from the first vehicle with the one or more sensor systems of the first vehicle;

detecting a failed sensor associated with the one or more sensor systems of the first vehicle; and simulating the failed sensor using the correlated one or more sets of vehicle sensor data associated with the one or more sensor systems of the first vehicle.

9. A computer program product, comprising a non-transitory tangible storage device having program code embodied therewith, the program code executable by a processor of a computer to perform a method, the method comprising:

receiving one or more sets of vehicle sensor data from a first vehicle, wherein the one or more sets of vehicle sensor data correspond to one or more sensor systems of the first vehicle;

mapping the received one or more sets of vehicle sensor data with one or more candidate vehicle events, based on one or more sets of archived vehicle sensor data;

identifying one or more relationships between the received one or more sets of vehicle sensor data and the one or more candidate vehicle events;

detecting, by a second vehicle, the one or more candidate vehicle events of the first vehicle, wherein the second vehicle is within a pre-defined proximity of the first vehicle; and providing an alert, to the first vehicle, that conveys the identified one or more relationships between the received one or more sets of vehicle sensor data and the one or more candidate vehicle events.

10. The computer program product of claim 9, further comprising:

adding the identified one or more relationships between the received one or more sets of vehicle sensor data and the one or more candidate vehicle events to the one or more sets of archived vehicle sensor data.

11. The computer program product of claim 9, further comprising:

receiving a first set of vehicle sensor data corresponding to a first set of vehicle sensors;

receiving a second set of vehicle sensor data corresponding to a second set of vehicle sensors;

determining a correlation between the first set of vehicle sensors and the second set of vehicle sensors; and building a correlation model between the first set of vehicle sensors and the second set of vehicle sensors, based on the determined correlation.

12. The computer program product of claim 11, further comprising:

detecting that the first set of vehicle sensors has encountered a failure event; and associating the failure event of the first set of vehicle sensors with the one or more candidate vehicle events, based on the correlation model.

13. The computer program product of claim 12, further comprising:

in response to detecting that the first set of vehicle sensors has encountered a failure event, receiving a snapshot of the one or more sensor systems of the first vehicle;

aggregating the snapshot of the one or more sensor systems of the first vehicle;

determining one or more associations between the failure event and the received snapshot of the one or more sensor systems of the first vehicle; and updating the correlation model to include the one or more associations between the failure event and the received snapshot of the one or more sensor systems of the first vehicle.

14. The computer program product of claim 9, further comprising:

correlating the one or more sets of vehicle sensor data from the first vehicle with the one or more sensor systems of the first vehicle;

detecting a failed sensor associated with the one or more sensor systems of the first vehicle; and simulating the failed sensor using the correlated one or more sets of vehicle sensor data associated with the one or more sensor systems of the first vehicle.

15. A computer system, comprising:

one or more computer devices each having one or more processors and one or more tangible storage devices; and a program embodied on at least one of the one or more storage devices, the program having a plurality of program instructions for execution by the one or more processors, the program instructions comprising instructions for:

receiving one or more sets of vehicle sensor data from a first vehicle, wherein the one or more sets of vehicle sensor data correspond to one or more sensor systems of the first vehicle;

mapping the received one or more sets of vehicle sensor data with one or more candidate vehicle events, based on one or more sets of archived vehicle sensor data;

identifying one or more relationships between the received one or more sets of vehicle sensor data and the one or more candidate vehicle events;

detecting, by a second vehicle, the one or more candidate vehicle events of the first vehicle, wherein the second vehicle is within a pre-defined proximity of the first vehicle; and providing an alert, to the first vehicle, that conveys the identified one or more relationships between the received one or more sets of vehicle sensor data and the one or more candidate vehicle events.

16. The computer system of claim 15, further comprising:

adding the identified one or more relationships between the received one or more sets of vehicle sensor data and the one or more candidate vehicle events to the one or more sets of archived vehicle sensor data.

17. The computer system of claim 15, further comprising:

receiving a first set of vehicle sensor data corresponding to a first set of vehicle sensors;

receiving a second set of vehicle sensor data corresponding to a second set of vehicle sensors;

determining a correlation between the first set of vehicle sensors and the second set of vehicle sensors; and building a correlation model between the first set of vehicle sensors and the second set of vehicle sensors, based on the determined correlation.

18. The computer system of claim 17, further comprising:

detecting that the first set of vehicle sensors has encountered a failure event; and associating the failure event of the first set of vehicle sensors with the one or more candidate vehicle events, based on the correlation model.

19. The computer system of claim 18, further comprising:

in response to detecting that the first set of vehicle sensors has encountered a failure event, receiving a snapshot of the one or more sensor systems of the first vehicle;

aggregating the snapshot of the one or more sensor systems of the first vehicle;

determining one or more associations between the failure event and the received snapshot of the one or more sensor systems of the first vehicle; and updating the correlation model to include the one or more associations between the failure event and the received snapshot of the one or more sensor systems of the first vehicle.

* * * * *